United States Patent [19]

Wait

[11] Patent Number: 4,793,496

[45] Date of Patent: Dec. 27, 1988

[54] WALL-MOUNTED SKI STORAGE UNIT

[75] Inventor: Brooks T. Wait, Littleton, Colo.

[73] Assignee: Ski Tree Products, Inc., Missoula, Mont.

[21] Appl. No.: 92,506

[22] Filed: Sep. 3, 1987

[51] Int. Cl.[4] ..... A47F 7/00

[52] U.S. Cl. ..... 211/70.5; D6/552

[58] Field of Search ..... D6/552; 211/70.5

[56] References Cited

U.S. PATENT DOCUMENTS

| | | | |
|---|---|---|---|
| D. 229,806 | 1/1974 | Hasser | D6/552 |
| D. 232,886 | 9/1974 | Borvaccio | D6/552 |
| D. 239,903 | 5/1976 | Donaldson | D6/552 |
| D. 245,741 | 9/1977 | Putt | D6/552 |

FOREIGN PATENT DOCUMENTS

| | | | |
|---|---|---|---|
| 620818 | 12/1980 | Switzerland | 211/70.5 |

OTHER PUBLICATIONS

Popular Mechanics, 2/1978, p. 124.

*Primary Examiner*—Robert W. Gibson, Jr.
*Attorney, Agent, or Firm*—William D. West

[57] ABSTRACT

A wall-mounted ski storage unit is disclosed. The unit provides a vertical wall-mounted base plate with sets of opposed outwardly extending curved arcuate ski-contoured pieces mounted substantially normal to the base plate for holding one or more sets of skis. A ski pole holder attached to the base plate and integral to the base plate is also disclosed.

6 Claims, 2 Drawing Sheets

WALL-MOUNTED SKI STORAGE UNIT

BACKGROUND OF THE INVENTION

1. Field of the Invention

This invention relates to a storage rack for storing skis and ski poles and in particular to a wall-mounted ski storage unit for storing a plurality of nordic and/or alpine skis and poles.

2. Discussion of the Technical Problems

Downhill or alpine skiing has enjoyed great popularity since the 1930's and in particular with new technology and materials for the production of skis, there has been an upsurge in popularity of the sport of skiing. Additionally, the fitness boom in the United States has induced ever increasing numbers of people to attempt nordic or cross country skiing so that cross country skiing has become an important recreational pursuit of many people.

While some skis, both downhill and cross country, are rented, the vast majority of skis are purchased by people as personal items. Unfortunately, it is difficult to store skis and ski poles as they are sometimes quite lengthy and cumbersome. In the past it has been found that one could store skis by stacking them in closets or in the corners where walls meet; however, such storage presents problems as it is unsightly, somewhat dangerous to skis and people who may trip over them. It also has deleterious effects on the walls. When skis are stored in closets or basements and the like, the skis themselves have suffered as the camber of the ski must be maintained in order to maintain the highest overall quality of the ski. So as not to warp skis, it has been found that skis can be suspended from their tips by the use of pegboards and the like. However, when suspending skis from pegboards, unless the ski brakes attached to bindings are locked together, the skis tend to separate and possibly fall from the pegboards.

Both downhill and cross country skis are quite expensive. It has been found that the less one has to move the skis, the less damage is incurred and the more one protects his investment. If it were possible to store skis in living rooms, in lodges, in condominiums and in other areas indoors where it is not necessary to move the skis through small doorways, down stairs and the like, skis would last longer and sustain less damage. Unfortunately, pegboards, nails driven into the walls and the like would be an unsightly addition to most homes and condominiums. Accordingly, a need exists for a unit for storing skis that can be placed upon a wall in which the article appears as any other type of furniture and yet holds the skis securely, safely, and without damage to the skis or to the wall.

Accordingly, a need exists for a wall-mounted ski rack or ski storage unit which would provide safe, convenient storage for skis and yet have the appearance of furniture, whether or not in use. Such a storage unit would provide a simple, inexpensive apparatus that could easily be mounted onto any wall, put into entryways, behind doors or into a corner to provide a refreshingly clean, contemporary, and uncluttered appearance. Such a ski storage unit could be made out of attractive wood, including oak finish and framed in walnut to provide a ski storage to provide ski storage with a style that would complement any home environment. Such a furniture-quality wall-mounted ski storage/display unit should be uncomplicated in design, easily mounted onto walls, doors, and the like. It should be not subject to damage by proper use and simple to manufacture. The instant invention is directed to all of these needs as well as to others as explained in the following summary.

SUMMARY OF THE INVENTION

It is a feature of the invention to provide a wall-mounted ski storage unit. It is another feature of the invention to provide a wall-mounted ski storage unit in which one or more sets of skis and poles can be stored on a wall or behind a door.

These and other features and objects are attained according to the instant invention by providing a wall-mounted ski storage unit having a vertical base plate and at least one set of arcuate ski-engaging surfaces attached substantially normal to the base unit so that the arcuate curves flare away from each other and provide a matching curvature for downhill and cross country skis to rest thereupon. The arcuate surfaces are formed in wood, plastic, or metal by conventional methods. The vertical base plate is provided with pre-countersunk holes for mounting the vertical base plate to any vertical surface such as a wall. The arcuate surfaces supporting the skis are somewhat elongate curved flat surfaces which flare not only at the top to engage the rounded tips of the skis but also are flared somewhat at their lower terminus so that the opposing flat surfaces are not entirely parallel but that the distance between the opposing surfaces is greater at the lower end than it is in the upper curved end at the closest point. The opposing flat surfaces thus provide the same contour as skis, thereby supporting skis in a manner which does not cause damage to the skis and yet provides a safe, compact ski storage unit. Additional pole-holding cutouts are attached to the base plate and extend substantially normal thereto in a horizontal plane. The grooves or cutouts provide for pole storage so that ski poles can be inserted within the slots therein. Once the poles are inserted within the slots, they will rest above the floor and not be subject to falling when the skis are removed.

BRIEF DESCRIPTION OF THE DRAWINGS

The advantage of this invention will become apparent upon consideration of the following detailed disclosure of the invention, especially when taken in conjunction with the accompanying drawings wherein.

DESCRIPTION OF THE PREFERRED EMBODIMENT

Figure 1:
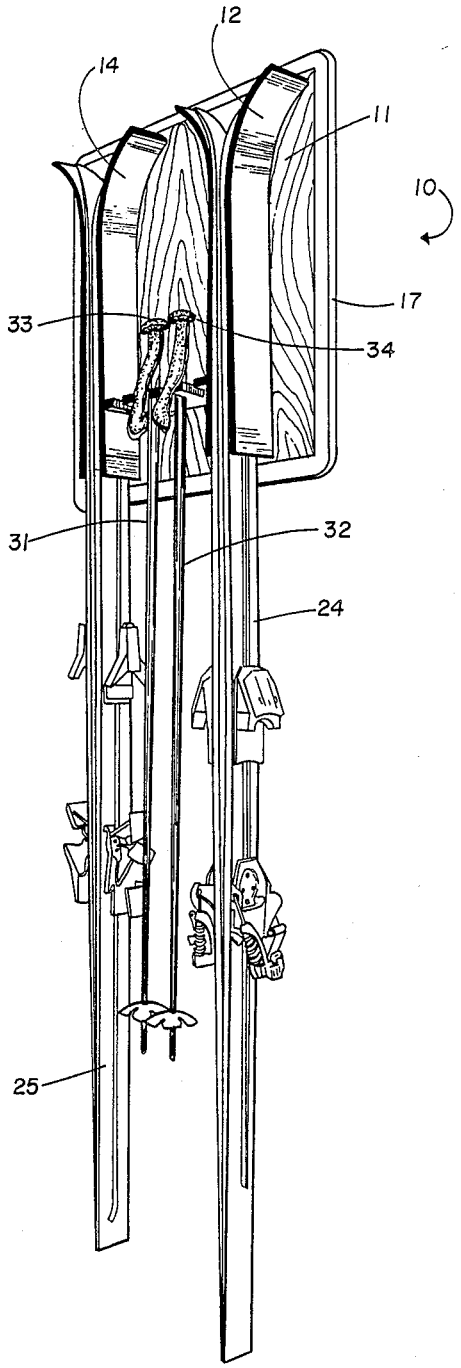
FIG. 1 is an elevational view of the wall-mounted storage unit showing two pairs of skis and a pair of poles being stored in the wall-mounted unit in accordance with the present invention.

The ski storage unit of the instant invention is depicted generally in FIG. 1 at numeral 10. As shown in FIG. 1, the storage unit 10 is provided with a vertical base plate 11 having attached to base plate 11 sets of curved strips 12. As can be seen by reference to FIGS. 2 and 3, curved strips 12, 13, 14, and 16 are mounted substantially normal or at a right angle to flat base plate 11 by any method in which the curved pieces 12, 13, 14, and 16 are securely attached. A curved slot matching the curvature of curved pieces 12, 13, 14, and 16 could be placed within vertical base 11 so that the curved pieces 12, 13, 14, and 16 mate with the resulting dado so that glue and/or screws could be used to insure the security of the attachment of curved pieces 12, 13, 14, and 16 to flat base 11. Additionally, decorative border strips 17 can be attached to the outer peripheral edge of flat base 11 so as to provide an even more pleasing appearance when mounted upon a wall.

While the ski storage unit of the present invention could be constructed of wood, metal, plastic, or the like, it has been found that the base plate 11 being constructed of a ¾-inch rectangular oak plywood base having a 1¼-inch wide and ¾-inch thick walnut strip 17 around the periphery make a pleasing furniture-quality construction of the invention. The overall dimension of the base 11 with the decorative strips 17 in the preferred embodiment has been shown to be 25 inches wide by 26 inches high by ¾ inch thick. The curved pieces 12, 13, 14, and 16 of wood that are ski shaped are constructed of a five-ply maple veneer. The curved pieces 12, 13, 14, and 16 as previously mentioned could have a chord of 3½ inches with a ¼-inch dado onto base 11. Thus the curved pieces 12, 13, 14, and 16 protrude out from the surface of the base 3¼ inches.

Figure 3:
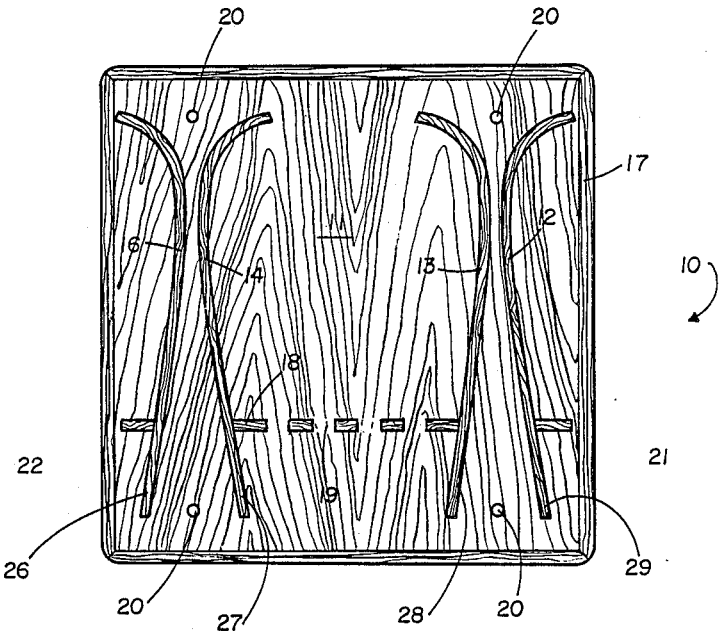
FIG. 3 is a front elevational view of the ski storage unit without any skis in place.

On a second model which would use provide storage for two sets of skis for each pair of curved pieces attached to the base would have a chord of 6 and ¾ inches with a ¼-inch dado onto base 11, leaving 6½ inches protruding from the surface of base 11. Thus if the arrangement were provided as depicted in FIG. 3, it would allow for four complete sets of skis to be stored.

Figure 4:
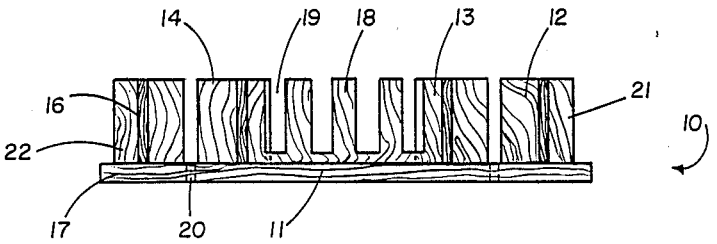
FIG. 4 is a bottom plan view of the ski storage unit shown without skis or poles in place, all in accordance with the present invention.

In addition to the curved pieces 12, 13, 14 and 16 mounted on base 11, there is also ski pole holder 18 which is a horizontal 13-ply piece of maple plywood being ¾ inch thick. As shown in FIG. 4, the ski pole holder 18 is provided with cutouts 19 which allow for the introduction of ski poles to rest thereupon.

It has been shown in the preferred embodiment that if the unit 10 is finished with a medium walnut oil stain that a very attractive piece of furniture and practical storage unit is provided. As shown in FIG. 3, wall-mounting holes 20 are provided throughout base 11 and an additional rounded wooden plug (not shown) could be inserted within the countersunk wall-mounting holes 20 to cover up the brass screws which are used to attach unit 10 to the wall.

An additional right-angle brace 21 and 22 is provided on the larger model which provides for storage for four skis, which further braces the structure.

With reference to FIG. 1, it can be seen that once the wall-mounted unit 10 is mounted upon a wall, that sets of skis 24 and 25 can be placed upon the unit since the contour of the tip portion of skis 24 and 25 co-act with the curved radius of matching curved pieces 12, 13, 14, and 16 to provide secured storage.

Figure 2:
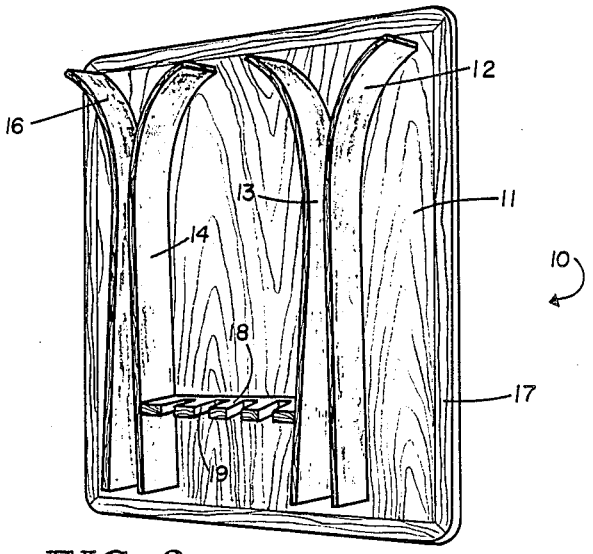
FIG. 2 is a perspective view of the ski storage unit of the present invention without skis being attached thereto.

As depicted in FIGS. 2 and 3, the lower portions 26, 27, 28, and 29 of curved pieces 16, 14, 13, and 12, respectively, are spaced farther apart than at curved portions of curved pieces, thereby insuring that curved pieces 12, 13, 14, and 16 match the contour of skis when placed in the unit for storage.

As shown in FIG. 1, ski poles 31 and 32 having handles 33 and 34, respectively, can be placed within ski pole holder 18 to securely hold ski poles 31 and 32 in place and away from skis 24 and 25 so that when removing skis 24 and 25, ski poles 31 and 32 are not disturbed and when moving ski poles 31 and 32, skis 24 and 25 do not have to be moved and would not fall down.

Although specific applications, materials, components, connections, sequences of events and methods have been stated in the above description of the preferred embodiment of the invention, other suitable materials, other applications, components, and process steps as listed herein may be used with satisfactory results and varying degrees of quality. In addition, it will be understood that various other changes in details, materials, steps, arrangements, parts, and uses which have been herein described and illustrated in order to explain the nature of the invention will occur to and may be made by those skilled in the art, upon a careful reading of this disclosure, and such changes are intended to be included within the principles and scope of this invention as hereinafter claimed.

I claim:

1. A wall-mounted ski storage unit comprising:

a vertical base means;

wall mounting means attached to said vertical base means;

pole holding means attached to said vertical base means; and at least two opposed ski-contoured holding means attached substantially normal to said vertical base means, each holding means having an upper arcuate portion and a lower substantially flat portion, wherein the upper arcuate portion provides a ski tip engaging surface, and the lower flat portion provides a ski top engaging surface, and wherein said upper arcuate portion and said lower flap portion of each contoured ski-holding means are joined to form a waist portion, and wherein said waist portion of each of said contoured ski-holding means is spaced at a closer distance from each other than said lower portions are spaced from each other.

2. The wall-mounted ski storage unit as described in claim 1 further comprising a decorative molding attached to said base means.

3. The wall-mounted ski storage unit as described in claim 2 wherein said mounting means is comprised of countersunk screw holes within said base means.

4. The wall-mounted ski storage unit as described in claim 3 further comprising support pieces attached between said base means and said lower flat portion of each of said ski contoured holding means.

5. The wall-mounted ski storage unit as described in claim 4 adapted to hold two sets of skis.

6. The wall-mounted ski storage unit as described in claim 4 adapted to hold four sets of skis.

* * * * *